United States Patent [19]

Martin

[11] 3,936,198

[45] Feb. 3, 1976

[54] BACK RUBBING DEVICE

[75] Inventor: William F. Martin, Ridgewood, N.J.

[73] Assignee: The Raymond Lee Organization, Inc., New York, N.Y. ; a part interest

[22] Filed: Aug. 12, 1974

[21] Appl. No.: 496,462

[52] U.S. Cl. ..... 401/8; 15/160; 15/222; 401/131; 401/200

[51] Int. Cl.² . A45D 33/02; A47K 7/03; A61H 7/00

[58] Field of Search ..... 15/222, 104.94; 128/57, 128/58, 62 R, 63, 67; 272/79 R; 401/8, 200

[56] References Cited

UNITED STATES PATENTS

| | | | |
|---|---|---|---|
| 718,594 | 1/1903 | Bailey | 15/222 X |
| 2,014,293 | 9/1935 | Riley | 15/222 UX |
| 2,318,680 | 5/1943 | Ellinger | 15/222 |
| 2,544,216 | 3/1951 | Brackmann | 15/222 |
| 2,549,933 | 4/1951 | Rohlffs | 128/58 X |
| 3,672,358 | 6/1972 | Majewski | 128/58 |

FOREIGN PATENTS OR APPLICATIONS

| | | | |
|---|---|---|---|
| 645,722 | 9/1962 | Italy | 15/222 |

*Primary Examiner*—Daniel Blum
*Attorney, Agent, or Firm*—Daniel Jay Tick

[57] ABSTRACT

A cord extends through a cylindrical member. A pair of rubber washer stop devices are frictionally mounted on the cord and are movably positionable on the cord for holding the member in a desired position on the cord. Handles are affixed to the ends of the cord. Sleeve-type covers are provided on the cylindrical member for application to the back of a user.

3 Claims, 9 Drawing Figures

BACK RUBBING DEVICE

DESCRIPTION OF THE INVENTION:

The present invention relates to a back rubbing device.

Objects of the invention are to provide a back rubbing device of simple structure, which is inexpensive in manufacture, assembled and disassembled with convenience, facility, ease, rapidity and simplicity, and functions efficiently, effectively and reliably to wash, dry, massage, powder, and relieve itching of the back of a user.

In order that the invention may be readily carried into effect, it will now be described with reference to the accompanying drawing, wherein.

The back rubbing device of the invention comprises a substantially cylindrical member 1 (FIGS. 2, 3, 4, 6 and 7). The cylindrical member 1 is preferably perforated in the manner shown in FIG. 7, so that it may be utilized to apply powder to the back of the user, in a manner hereinafter described.

A cord 2 (FIGS. 1, 2, 3, 4, 6 and 7) extends through the cylindrical member 1. A pair of rubber washer stop devices 3 and 4 (FIG. 2) are frictionally mounted on the cord 2 and are movably positionable on the cord, holding the member 1 in a desired position on the cord.

Figure 1:
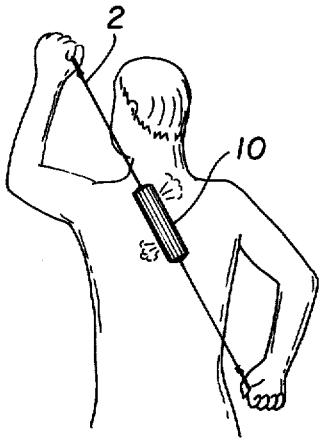
FIG. 1 is a view of an embodiment of the back rubbing device of the invention in use.
Figure 2:
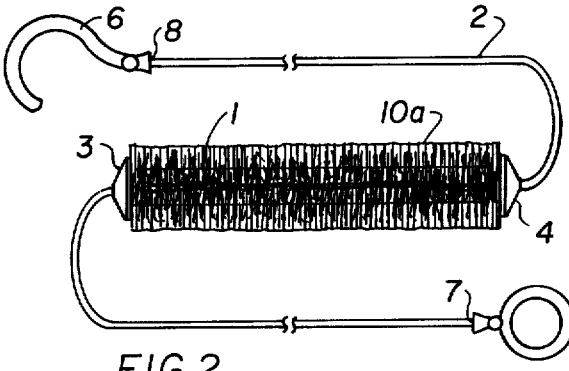
FIG. 2 is a view of an embodiment of the back rubbing device of the invention.
Figure 5:
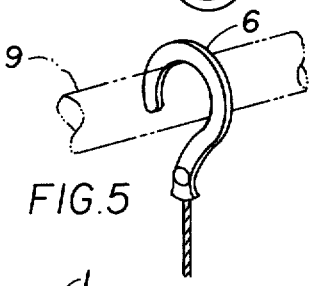
FIG. 5 is a view of a hook-type handle of the back rubbing device of the invention.
Figure 3:
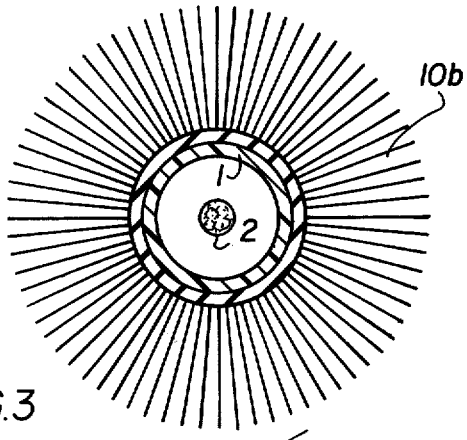
FIG. 3 is a cross-sectional view of the cylindrical member and a cover of the back rubbing device of the invention, on an enlarged scale.
Figure 4:
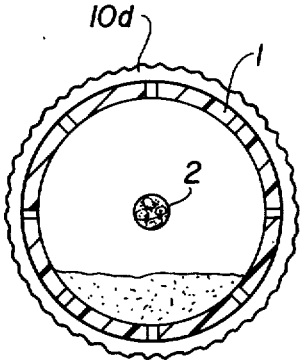
FIG. 4 is a cross-sectional view of the cylindrical member and another cover of the back rubbing device of the invention, on an enlarged scale.
Figure 6:
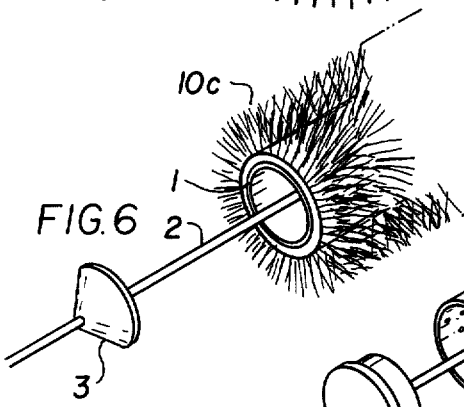
FIG. 6 is a schematic, exploded diagram of part of an embodiment of the back rubbing device of the invention.
Figure 7:
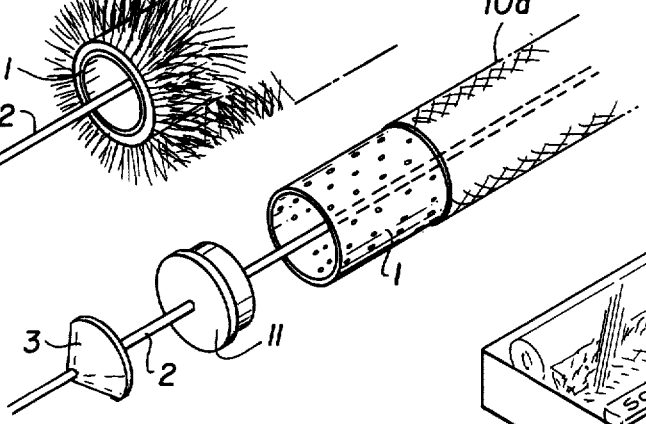
FIG. 7 is a schematic, exploded, diagram of part of another embodiment of the back rubbing device of the invention.

Handles 5 and 6 (FIG. 2) are affixed to the ends 7 and 8, respectively, of the cord 2. One of the handles 6 is a hook member which enables the device to hang on a shower rod 9, as shown in FIG. 5, when not in use.

Figure 8:
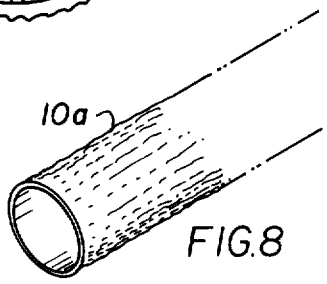
FIG. 8 is a schematic diagram of an embodiment of a cover of the back rubbing device of the invention.
Figure 9:
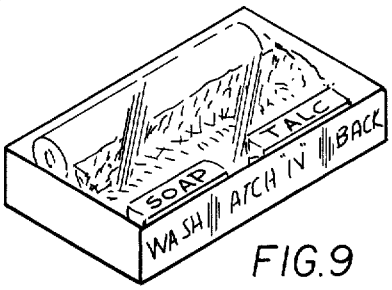
FIG. 9 is a schematic diagram of a package of the back rubbing device of the invention.

In accordance with the invention, a sleeve-type cover 10 (FIG. 1) is provided on the member for application to the back of the user. The sleeve-type cover 10 is removably fitted over the cylindrical member 1 and may comprise any suitable desired material dependent upon the function to be performed. Thus, for example, the sleeve-type cover may comprise sponge-type material **10*a* (FIGS. 2 and 8), for washing the back of the user, plastic needles 10*b* (FIG. 3) extending substantially radially for rubbing the back of the user, brush bristles 10*c* (FIG. 6) for brushing the back of the user, or permeable cloth 10*d* (FIGS. 4 and 7**) for powdering the back of the user.

When the user desires to powder his back, he fills the perforated cylindrical member 1 (FIG. 7) with talcum powder and closes the cylinder at its ends with caps 11 (FIG. 7) and 12 (not shown in the FIGS.). He then fits the permeable cloth cover **10*d* to the cylindrical member and moves the device over his back via the cord 2**.

While the invention has been described by means of specific examples and in specific embodiments, I do not wish to be limited thereto, for obvious modifications will occur to those skilled in the art without departing from the spirit and scope of the invention.

I claim:

1. A back rubbing device, comprising a substantially cylindrical member;

a cord extending through the member;

a pair of rubber washer stop devices frictionally mounted on the cord and movably positionable on the cord for holding the member in a desired position on the cord;

handle means affixed to the ends of the cord said handle means including a hook member affixed to one end of the cord for hanging the device on a shower curtain rod; and sleeve-type cover rubbing means on the member for application to the back of a user, said cover rubbing means comprising sponge-type material for washing the back of the user.

2. A back rubbing device as claimed in claim 1, wherein an alternative cover means includes plastic needles extending substantially radially for rubbing the back of the user.

3. A back rubbing device as claimed in claim 1, wherein the cylindrical member is perforated and an alternative cover means comprises permeable cloth whereby powder in the member may be applied to the back of the user.

* * * * *